United States Patent [19]

Davis et al.

[11] 4,086,650

[45] Apr. 25, 1978

[54] CORONA CHARGING DEVICE

[75] Inventors: Thomas G. Davis, Pittsford; George J. Safford, Webster, both of N.Y.

[73] Assignee: Xerox Corporation, Stamford, Conn.

[21] Appl. No.: 748,805

[22] Filed: Dec. 8, 1976

Related U.S. Application Data

[63] Continuation of Ser. No. 595,656, Jul. 14, 1975, abandoned.

[51] Int. Cl.[2] ..... H05F 3/04

[52] U.S. Cl. ..... 361/229; 361/230

[58] Field of Search ..... 361/229, 230; 250/324–326; 313/355, 357

[56] References Cited

U.S. PATENT DOCUMENTS

| | | | |
|---|---|---|---|
| 3,634,726 | 1/1972 | Jay | 361/213 |
| 3,775,104 | 11/1973 | Matsumoto et al. | 361/229 |

*Primary Examiner*—Harry E. Moose, Jr.

[57] ABSTRACT

A corona discharge device including a corona discharge electrode and a conductive shield located adjacent the electrode, the electrode being coated with relatively thick dielectric material so as to substantially prevent the flow of conduction current therethrough. The delivery of charge to the photoconductive surface is accomplished by means of a displacement current or capacitative coupling through the dielectric material. The flow of charge to the surface to be charged is regulated by means of a d.c. bias applied to the corona shield.

28 Claims, 2 Drawing Figures

CORONA CHARGING DEVICE

This is a continuation, of application Ser. No. 595,656, filed 7/14/75

BACKGROUND OF THE INVENTION

The present invention relates to a corona charging device for depositing charge on an adjacent surface. More particularly, it is directed to a corona charging arrangement usable in a xerographic reproduction system for generating a flow of ions onto an adjacent imaging surface for altering or changing the electrostatic charge thereon.

In the electrophotographic reproducing arts, it is necessary to deposit a uniform electrostatic charge on an imaging surface, which charge is subsequently selectively dissipated by exposure to an information containing optical image to form an electrostatic latent image. The electrostatic latent image may then be developed and the developed image transferred to a support surface to form a final copy of the original document.

In addition to precharging the imaging surface of a xerographic system prior to exposure, corona devices are used to perform a variety of other functions in the xerographic process. For example, corona devices aid in the transfer of an electrostatic toner image from a reusable photoreceptor to a transfer member, the tacking and detacking of paper to the imaging member, the conditioning of the imaging surface prior to, during, and after the deposition of toner thereon to improve the quality of the xerographic copy produced thereby.

Both d.c. and a.c. type corona devices are used to perform many of the above functions.

The conventional form of corona discharge device for use in reproduction systems of the above type is shown generally in U.S. Pat. No. 2,836,725 in which a conductive corona electrode in the form of an elongated wire is connected to a corona generating d.c. voltage. The wire is partially surrounded by a conductive shield which is usually electrically grounded. The surface to be charged is spaced from the wire on the side opposite the shield and is mounted on a grounded substrate. Alternately, a corona device of the above type may be biased in a manner taught in U.S. Pat. No. 2,879,395 wherein an a.c. corona generating potential is applied to the conductive wire electrode and a d.c. potential is applied to the conductive shield partially surrounding the electrode to regulate the flow of ions from the electrode to the surface to be charged. Other biasing arrangements are known in the prior art and will not be discussed in great detail herein.

Several problems have been historically associated with such corona devices. A first problem has been inability of such devices to deposit relatively uniform negative charge on an imaging surface.

More specifically, when a corona electrode in a device of the above type is biased with a negative corona generating potential, the charge density varies greatly along the length of the wire resulting in a corresponding variation in the magnitude of charge deposited on associated portions of an adjacent surface to be charged. This problem is visually verified as glow spots along the length of the corona wire when negative corona potentials are applied as contrasted to the more uniform corona glow when positive potentials are applied. More basically, the nonuniformity is believed to result from the fact that negative corona is initiated by high field stripping of electrons from the surface of the wire and sustained in large measure by secondary emission processes at the surface. This secondary emission process is easily affected by surface contamination which typically occurs from chemical growths on these surfaces. Positive ion bombardment also is believed to contribute to the nonuniformity problem by partially cleaning portions of the wire, which cleaned portions become emitters or relatively high current with respect to the remainder of the wire.

The above problem of nonuniform negative charging is addressed in U.S. Pat. Nos. 3,813,549 and 3,789,278 and it is suggested therein that various thin dielectric coatings be applied to the metallic wire electrode of the conventional corona charging arrangements while applying a negative d.c. potential to the corona electrode in order to lessen such nonuniformity. Improved uniformity, it is suggested therein, may result from the localized current limiting provided by the thin dielectric.

More specifically, U.S. Pat. No. 3,789,278 suggests the use of a thin high resistivity coating spread uniformly over the surface of a valve metal wire electrode. U.S. Pat. No. 3,813,549 suggests the use of a thin dielectric coating over the surface of a metallic wire electrode. In both of the above arrangements, a d.c. potential is used to energize the wire and a d.c. current through the coatings is used to deposit charge on an adjacent surface. The coatings suggested for use in these patents, while being made of dielectric materials, must of necessity be sufficiently thin to permit the passage of d.c. charging current therethrough.

A further problem associated with conventional corona discharge devices employing a conductive wire is a result of the fact that corona glow is associated with a region of high chemical reactivity where chemical compounds are synthesized from machine air, which results in chemical growths being built up on the surface of the wire. These chemical growths, after a prolonged period of operation, degrade the performance of the corona device. Since free oxygen and ozone are produced in the corona region the corona electrode must of necessity be highly oxidation resistant. The above problem of chemical growth build-up on the wire has been addressed by the provision of wire materials which are less subject to chemical attack. While this has reduced the problem, such materials have substantially increased the cost of corona devices.

A still further problem associated with corona discharge devices operating in a xerographic environment results from toner accumulations on the surface of the corona electrode. The spots of accumulated toner, being dielectric in nature, tend to cause localized charge build up on the interior surfaces of the shield which produces current nonuniformity and reduction in corona current. Localized toner accumulations on the insulating end blocks which support the wire electrode also cause sparking.

A still further disadvantage of prior art corona discharge devices is the fact that d.c. charging current is drawn through the wire and passes therefrom along either of two parallel paths. The first path includes the air space between the corona electrode and the surrounding conductive shield, and the shield itself, which is usually grounded. The second path includes the air space between the corona electrode and the surface to be charged, the surface itself and the grounded substrate on which the surface is carried. Since the surface to be charged rests directly on a grounded substrate, and since this arrangement has the obvious advantage of not having to electrically isolate the photoconductive drum above ground, it is not possible to measure directly the charging current flowing to the surface to be charged. The charging current to the surface can be determined only when both the total current to the wire and the current drawn by the shield are known (assuming a directly grounded photoconductor support). The problem is compounded when several corona generators are operated from a common supply. Such an electrical arrangement has conventionally required either a complex electrical arrangement or a less direct method (electrometer) to sense and control currents accurately. An improved system which operates to more easily compute corona charging current in the above noted environment is disclosed in copending patent application, Ser. No. 572,683, filed Apr. 28, 1975, and commonly assigned. The arrangement disclosed in the above application is necessitated by prior art corona charging arrangements wherein d.c. corona current drawn by the corona electrode is delivered to both the shield and the surface to be charged.

Yet another problem has been associated with the use of corona generators energized by an a.c. source for the purpose of reducing to zero or neutralizing the charge on a surface. This is a well known process and relies on the voltage sensitivity characteristics of corona generators. More specifically, the amount and polarity of charge delivered to a charged surface is a function of the polarity and magnitude of the charge on that surface. Thus, if the surface having a net positive charge on it is exposed to an a.c. corona generator, the negative current pulses delivered to the surface will be slightly greater than the positive pulses. After a number of cycles this action tends to reduce the positive charge on the surface. In order to completely neutralize the charge, i.e., to reduce the charge to zero, the corona generator must have the characteristics of delivering a zero d.c. current when exposed to surface with no net charge thereon. This latter characteristic is not generally an inherent property of conventional corona generators used in xerographic machines. One prior art solution to this problem is to place a d.c. bias on the corona electrode about which the a.c. corona generating voltage varies. Another proposed solution, suggested by U.S. Pat. No. 3,714,531, is to selectively place different resistances in series with the corona electrode during alternate half cycles, thus equalizing charge generation. Both solutions have the disadvantage of requiring additional external biasing components. In addition, the charge output of such arrangements tends to change significantly with temperature and humidity.

A further disadvantage of prior art corona devices is the inflexible nature of their characteristic output. As is well known in the art, corona devices of the type disclosed herein produce charging current ($Ip$) of a magnitude which is a function of the potential on the charge accepting surface ($Vp$).

A curve relating charging current to the potential of an adjacent charge accepting surface at a given corona producing voltage will be referred to hereinafter as the I-V curve and is important in determining the effect of a corona device on the surface to be charged. For many applications, it is desirable to adjust the slope of the $I_p$-$V_s$ curve and the location of the $Ip=0$ intercept on this curve. In prior art devices adjustment of the slope of the I-V curve was not possible without a substantial change in the $Ip=0$ intercept.

It would, therefore, be desirable to provide a corona device having a I-V curve which was easily adjusted in slope.

Yet another problem of lesser consequence than those previously alluded to is the vibration associated with the suspension of a relatively thin metal filiment in a high electric field employed in corona discharge devices.

OBJECTS AND SUMMARY OF THE INVENTION

This invention has as its primary object the provision of a corona device for use in xerographic reproduction machines which overcomes or reduces the problems outlined above which are associated with corona generating devices of the prior art.

A further object is the provision of a corona discharge device suitable for use in xerographic reproduction machines which is capable of depositing a negative charge on a collecting surface, which charge is substantially more uniform than that deposited by prior art bare wire corona devices.

Another object is to provide a corona generator which functions to deposit either negative charge or positive charge onto a collecting surface depending on the electrical bias voltage applied to the shield thereof without any changes in the A. C. corona generating potential applied to the corona electrode.

Another object is the provision of a corona generator which is less subject to attack through oxidation, less effected by chemical growths deposited thereon in a typical xerographic reproduction machine environment, and less effected by dirt and toner accumulation on the shield and support blocks.

A still further object is to provide a corona discharge device having a I-V characteristic curve which may be readily changed in slope without concurrent changes in the zero charging current intercept, as will be discussed in more detail hereinafter.

Still another object is to provide a corona generator electrode that is less subject to vibration than prior art electrodes and which offers a reduced risk of sparking to adjacent surfaces.

Each of the above problems or disadvantages of the prior art is alleviated, lessened, or eliminated by the unique corona discharge arrangement of the invention which comprises a corona electrode coated with a relatively thick dielectric material and located adjacent a conductive shield. Spaced from the wire is a charge collecting surface which may be carried on a grounded substrate.

In one mode of operation, an a.c. corona generating voltage is applied to the wire and no electric field is established between the collecting surface and the shield by holding each at the same reference potential. When operated in this mode, no net charging current is delivered to the surface.

In a second mode, a d.c. field is established between the shield and the surface which acts to control both the polarity and the magnitude of charging current delivered to the surface.

DETAILED DESCRIPTION OF THE INVENTION

Figure 1:
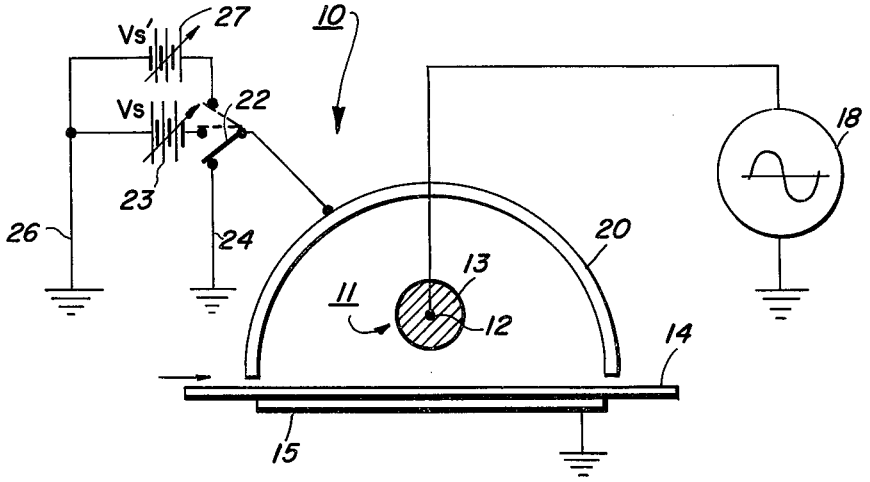
FIG. 1 is an illustrative cross-section of the corona discharge device according to the invention.

Referring to the drawings, the corona generator 10 of this invention is seen to comprise a corona discharge electrode 11 in the form of a conductive wire 12 having a relatively thick coating 13 of dielectric material.

A charge collecting surface 14 is shown which may be a photoconductive surface in a conventional xerographic systems. The charge collecting surface 14 is carried on a conductive substrate 15 held at a reference potential, usually machine ground. An a.c. voltage source 18 is connected between the substrate 15 and the corona wire 12, the magnitude of the a.c. source being selected to generate a corona discharge adjacent the wire 12. A conductive shield 20 is located adjacent the corona wire on the side of the wire opposite the chargeable surface.

The shield 20 has coupled thereto a switch 22 which, depending on its position, permits the corona device to be operated in either a charge neutralizing mode or a charge deposition mode. With the switch 22 as shown, the shield 20 of the corona device is coupled to ground via a lead 24. In this position, no d.c. field is generated between the surface 14 and the shield 15 and the corona device operates to neutralize over a number of a.c. cycles any charge present on the surface 14.

With switch 22 in either of the positions shown by dotted lines, the shield is coupled to one terminal of a d.c. source 23 or 27, the other terminals of the sources being coupled by lead 26 to ground thereby establish a d.c. field between the surface 14 and the shield 20. In this position, the corona operates to deposit a net charge onto the surface 14 the polarity and magnitude of this charge dependent on the polarity and magnitude of the d.c. bias applied to the shield 20.

The corona wire 13 may be supported in conventional fashion at the ends thereof by insulating end blocks (not shown) mounted within the ends of shield structure 20. The wire 12 may be made of any conventional conductive filiment materials such as stainless steel, gold, aluminum, copper, tungsten, platinum or the like. The diameter of the wire 11 is not critical and may vary typically between 0.5 - 15 mil. and preferably is about 3-6 mils.

Any suitable dielectric material may be employed as the coating 13 which will not break down under the applied corona a.c. voltage, and which will withstand chemical attack under the conditions present in a corona device. Inorganic dielectrics have been found to perform more satisfactorily than organic dielectrics due to their higher voltage breakdown properties, and greater resistance to chemical reaction in the corona environment.

The thickness of the dielectric coating 13 used in the corona device of the invention is such that substantially no conduction current or d.c. charging current is permitted therethrough. Typically, the thickness is such that the combined wire and dielectric thickness falls in the range from 10-30 mil with typical dielectric thickness of 2-10 mil. Glasses with dielectric breakdown strengths above 5 KV/mm. have been found by experiment to perform satisfactorily as the dielectric coating material. The glass coating selected should be free of voids and inclusions and make good contact with or wet the wire on which it is deposited. Other possible coatings are ceramic materials such as Alumina, Zirconia, Boron Nitride, Beryllium Oxide and Silicon Nitride. Organic dielectrics which are sufficiently stable in corona may also be used.

The frequency of the a.c. source 18 may be varied widely in the range from 60 hz. commercial source to several megahertz. The device has been operated and tested at 4KHz. and found to operate satisfactorily.

The shield 20 is shown as being semi-circular in shape but any of the conventional shapes used for corona shields in xerographic charging may be employed. In fact, the function of the shield 20 may be performed by any conductive member, for example, a base wire, in the vicinity of the wire, the precise location not being critical in order to obtain satisfactory operation of the device.

OPERATION AS NEUTRALIZING DEVICE

With the switch 22 connected as shown so that the shield 20 is grounded, the device operates to inherently neutralize any charge present on the surface 14. This is a result of the fact that no net d.c. charging current passes through the electrode 11 by virtue of the thick dielectric coating 13 on the wire 12.

To more fully understand the outstanding characteristics of the corona device of the invention, reference will be had hereinafter to FIG. 2 in which curves A-D represent characteristics of the a.c. corona device of the invention when operated at various d.c. shield bias potentials Vs selected near the middle of the ranges specified hereinafter.

The potential $Vp$ of the collecting surface is plotted on the horizontal axis and the d.c. charging current $Ip$ is plotted on the vertical axis. Curve H represents the typical characteristic of a prior art bare metal electrode operated at a corona generating a.c. potential with both shield and chargable held at ground potential. Curves E and F show the effect on the characteristic curves of the invention of increasing or decreasing the magnitude of the applied a.c. corona generating potential. Typical a.c. voltages applied to the corona electrode are in the range from 4Kv to 6Kv at a frequency between 1 KHz. and 10 KHz. Shield bias voltages are in the range of 0-6Kv.

Figure 2:
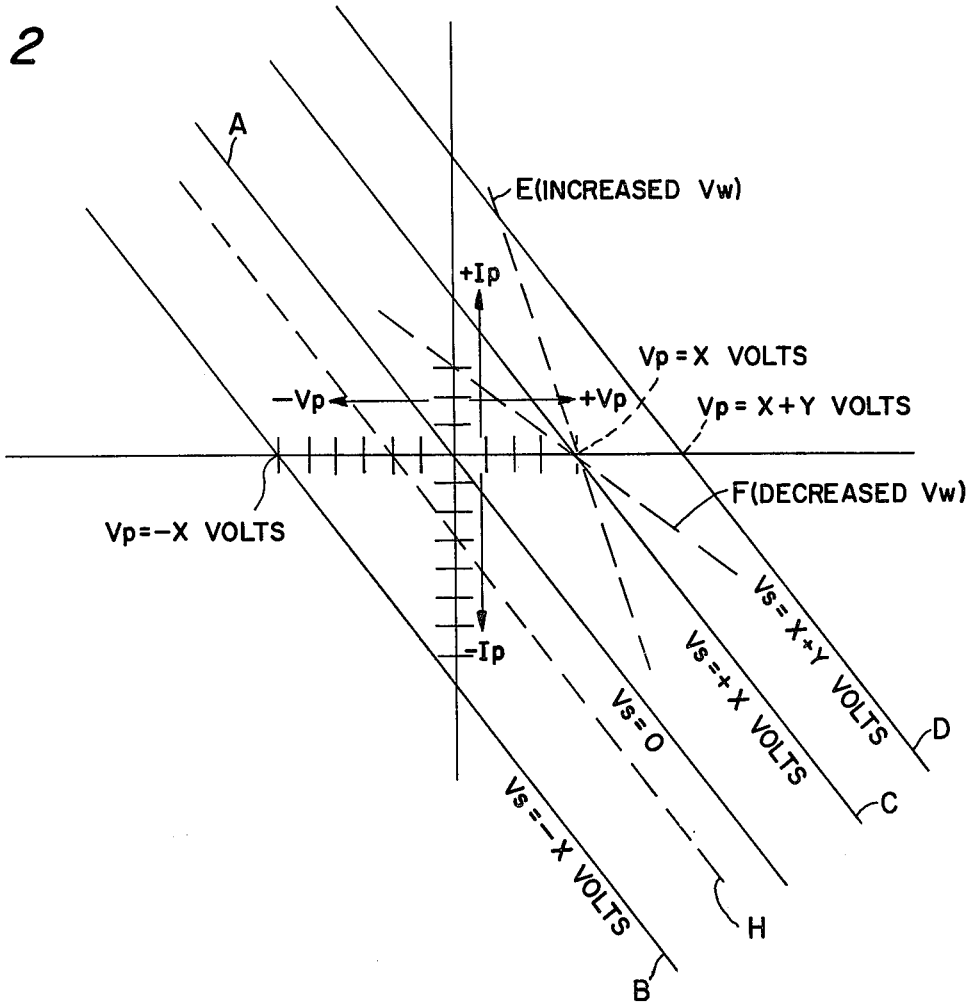
FIG. 2 is a graph showing typical I-V characteristics of a corona device according to the invention as contrasted to curves of prior art devices.

It should be noted at this point that FIG. 2 is presented primarily to foster an understanding of the typical characteristics of the corona device of the invention and is not intended to represent the characteristics of any particular configuration, such specific values being a function of a variety of parameters.

In order to understand why the corona device of the invention operates to completely neutralize charge present on a collecting surface when operated in a first mode with zero shield bias, reference is made to Curves A and H of FIG. 2.

From an examination of Curve H, it is seen that prior art devices, when operated in an a.c. mode with the shield grounded, so not completely neutralize a charged surface. More specifically, curve H indicates that a prior art corona device would deliver a net negative d.c. current ($-Ip$) to the collecting surface when that surface was completely neutralized ($Vp=0$). This negative current would tend to bring the collecting surface to a net negative final potential.

The above characteristic of prior art a.c. corona devices results from the greater mobility of negative ions. This phenomenon is well documented in the prior art as noted hereinbefore. The above inherent asymmetry in the operation of prior art a.c. devices has historically required the use of external biasing arrangements or electrical components to obtain complete neutralization of a charged surface. While such external biasing arrangements allow for a neutralizing action by an a.c. corona device, the output of corona generators operated in this manner is subject to change due to ambient conditions such as temperature and humidity. In addition, changes in the biasing voltages may occur as a result of power supply drift.

As contrasted to this, Curve A shows that the corona device of the invention has a characteristic which delivers substantially no net charge to a grounded surface. This latter characteristic is an inherent feature of the corona device of the invention and is caused by the thick dielectric coating on the corona wire. The asymmetry problem caused by the relatively greater mobility of negative charges referred to above is compensated for inherently by this accumulation of a net charge on the surface of the dielectric 13. This net charge forces the corona device to deposit equal positive and negative charges onto the collecting surface over each cycle of a.c.

The net charge which accumulates on the dielectric surface also imposes a condition on the minimum thickness of dielectric which may be used, as will be explained in greater detail hereinafter. It is critical that the dielectric be sufficiently thick and uniform not to break down or allow the passage of localized current as a result of this charge buildup.

The above noted characteristic of 0 d.c. output current to a grounded surface does not change with temperature or humidity because the condition of 0 d.c. current results from the inherent operation of the device and is independent of atmospheric conditions.

OPERATION TO DEPOSIT NET CHARGE

Referring to FIG. 1, operation of the corona device of the invention to deposit a specific net charge on an imaging surface is accomplished by moving switch 22 to one of the positions shown in dotted lines, whereby a d.c. potential of either positive polarity (source Vs') or negative polarity (source Vs') with respect to the surface 15 may be applied to the shield.

Referring again to FIG. 2, it is seen that the result of applying a d.c. bias $Vs$ to the shield 20 is to shift the $Vs=0$ characteristic curve to the right (Curve C), or to the left (Curve B) without substantially changing the slope of the curve. Thus, a shield bias voltage of +X volts results in a characteristic curve C, this curve being characterized by an $Ip=0$ intercept of some positive value. Likewise, a −X volt bias on the shield would produce a characteristic Curve B having the same slope as curves A and C but having an $Ip=0$ intercept occurring at some negative collecting surface potential.

The fact that the characteristic curves of the corona device according to this invention can be shifted by changes in shield bias without a significant corresponding change in the slope of the curves over a wide range is not found in prior art corona generators. Such a characteristic has important advantages in the use of selective corona devices for conditioning of the toned photoreceptor surface, as with pretransfer devices currently used in xerographic machines.

As mentioned hereinbefore, the characteristic curves shown in FIG. 2 are only a generalization of typical curves possible with the corona device of the invention, the exact characteristic depending on various parameters such as operating voltages, shield and wire configuration, dielectric coating materials, etc.

If the value of the applied a.c. voltage Vw is changed, the characteristic curve for any given value of $Vs$ would maintain the same $Ip=0$ intercept, but would change in slope. Thus, if the value of the a.c. corona potential applied to the wire of the corona device from which curve C was obtained was increased, curve E would result. It is to be noted that curve E has the same $Ip=0$ intercept, but a different slope as curve C. Thus a change in the applied a.c. corona generating voltage changes in the slope without a concurrent change in the $Ip=0$ intercept. The advantages of such a feature in designing corona devices for various xerographic process stages are well understood by those skilled in the art.

Thus, two surprising characteristics of the corona device of the invention when operated to deposit net d.c. charge are demonstrated by the curves in FIG. 2. The first is that by varying the magnitude of the shield bias $Vs$ the characteristic curve is shifted to the left or right (depending on the polarity of the shield bias) without any change in slope, and the second is that by increasing or decreasing the magnitude of the applied a.c. corona generating voltage, the slope of the characteristic curve is increased or decreased respectively.

Also, as can be seen from the curves of FIG. 2, the final charge deposited on a collecting surface by the corona device of the invention is equal in magnitude and polarity to the bias applied to the shield $Vs$. Thus, if the switch 22 of FIG. 1 were connected to apply a positive potential of +X volts to the shield, the imaging surface 14 would be charged to a potential of X volts (assuming a long enough exposure time). If the shield is biased with a voltage of −X volts, the surface 14 charge toward a final voltage of −X volts. When the surface to be charged reaches a potential which is equal to that applied to the shield no further charging current is drawn and the charge on the surface remains unchanged thereafter. Thus, the device of the invention operates in a manner similar to charging device shown in U.S. Pat. Nos. 2,879,395 and mentioned hereinbefore.

The operation of the shield bias voltage $Vs$ in determining the final net charge on an adjacent surface may be understood from the following explanation. Assume initially that both the shield and the surface to be charged are at ground potential ($Vs=0$). Although the corona discharge continuously produces positive ions and electrons, there is no appreciable net current to either the shield or the charge receptor. This is true because on the negative half cycle of the a.c. potential applied to the coronode, each adjacent surface (shield and charge receptor) receives a negative charge. On the succeeding positive half cycle, an equal amount of positive charge is deposited. This condition, as explained previously, is a consequence of the thick dielectric coating which does not permit a net d.c. coronode current. Without a dielectric coating, a net current would occur, since the positive and negative charge carriers have different mobilities. In the present invention, the surface of the dielectric coating acquires a net charge which just counterbalances the effect of the difference in mobilities. This action is inherent in the device, and the surface charge will automatically adjust to the proper value, even compensating for changes in humidity, temperature, pressure, and other variations in gas properties to which the device might be subjected. Thus, where $Vs=0$ and the charge receptor surface is initially charged to same potential, the potential of the surface will be reduced to zero. If the surface is neutralized to begin with, it will remain so.

When a voltage, $V_s$, is applied to the shield, electric field is generated between the shield and the surface to be charged. This electric field alters the division of current to the shield and the surface to be charged which hereinafter existed when no field was present ($V_s=0$). With the shield biased positively with respect to the charge receptor surface, a greater fraction of the positive ions adjacent the wire is directed toward the charge receptor surface on the positive half cycle of the potential applied to the coronode. Similarly, on the negative half cycle, a smaller fraction of negative charges is directed toward the charge receptor surface. These combined actions result in a net d.c. current to the charge receptor surface, and an equal and opposite current to the shield. This process continues until the surface reaches the shiel potential $V_s$. The converse of the above-noted action action takes place when a negative potential $V_s$ is applied to the shield with respect to the charge receptor surface.

Although it is rigorously true that the d.c. currents to the shield and charge receptor are always equal and opposite, it is not rigorously true that the d.c. currents are zero when the shield and charge receptor are at the same potential. For geometrics in which the spacing between the coronode and shield is approximately the same as between the coronode and charge receptor, the currents are negligible compared to useful currents in xerographic charging. By constructing very asymmetric configurations, the current can be made to approach useful levels in the absence of applied biases.

OUTSTANDING CHARACTERISTICS

As was noted previously, the corona device of the invention does not degrade as rapidly as prior art devices from the chemical growths occurring on its surface. In fact, testing has suggested that the useful life of a corona device constructed in accordance with the invention may be 3 to 4 times longer than conventional corona devices.

While the reasons surrounding this unexpected increase in useful life are not fully known, the following is believed to contribute to these results. Although growths proceed at about the same rate on both metal and glass surfaces, growths on a metal surface change the nature of the surface and ultimately inhibit corona at the growth sites. On the other hand, growths on a dielectric or glass surface serve merely as extensions of the dielectric surface and consequently do not significantly affect corona.

Furthermore, some growths are believed to be caused in part by localized "punch-through or breakdown effects" resulting from the build up of charge across an insulating type of deposit or growth. When the charge across the deposit becomes great enough, a localized discharge occurs across the deposit which causes even more serious growths. The above noted effects are eliminated in the corona device of the invention by the provision of the thick dielectric coating the breakdown field of which is not exceeded during operation of the device.

Still another factor related to chemical growth on the electrode is surface texture. Evidence suggests that rough wire surfaces tend to form growths more easily. Since the dielectric coating according to the invention may be deposited by various coating techniques a more smooth outer surface is possible. This is particularly true of a glass dielectric where an optically smooth surface is possible.

The corona device of the invention has also been found to accumulate less toner in use in a xerographic environment and to be less affected by such accumulation. Less toner is deposited on the shield of the corona device of the invention operated with a shield bias since this bias creates an electric field which drives toner toward the photoreceptor rather than the shield. Furthermore, when the corona device of the invention is operated to a frequency of above 1 KHz., here is a tendency to deposit less net charge on a circulating toner particle, thereby reducing its tendency to be attracted to a surface. Experimental data also has shown that the toner which is deposited on the surfaces of a corona device according to the invention has less effect on the output and uniformity of the device, as compared to prior art devices.

Partly the result of the favorable characteristics noted above with respect to toner accumulation and chemical growth, and partly due to factors not yet understood, the corona device of the invention has exhibited an outstanding improvement in the uniformity of negative charge deposited on a photoreceptor. In prior art base wire corona devices, the magnitude of charge delivered from discrete areas along the length of the wire may vary between $\pm$ 75% when energized by a negative d.c. corona generating potential. Contrasted to this, when the device according to FIG. 1 is operated with a negative shield bias $V_s$, a variation of only $\pm$ 3% in charge density along the length of the wire has been observed. This compares generally to the uniformity obtained from prior art base wire corona devices energized by a positive d.c. potential.

While the invention has been shown and described with reference to the preferred embodiment thereof, it should be understood by those skilled in the art that changes in form and detail may be made without departing from the spirit and scope of the invention.

What is claimed is:

1. In combination, a charge collecting surface, said surface carried on with a conductive substrate held at a reference potential, a corona discharge member positioned above said surface, said member comprising a thin wire, coated at least in the discharge area with a dielectric material, means for coupling a corona generating a.c. voltage intermediate said substrate and said wire, a conductive shield adjacent said wire and first biasing means for holding said shield at a potential different than said reference potential, said dielectric material having a thickness sufficient to prevent the flow of a net d.c. current though said wire.

2. The combination recited in claim 1 wherein said reference potential is ground.

3. The combination recited in claim 1 further including second biasing means for biasing said shield to a positive or negative d.c. potential with respect to said reference potential.

4. The combination recited in claim 1 wherein said material is glass.

5. A method for depositing a charge on an adjacent surface comprising the steps of locating a corona discharge electrode adjacent said surface, the electrode including a coating of dielectric material to prevent the passage of a d.c. current therethrough, coupling an a.c. corona generating potential to said electrode, positioning a conductive shield adjacent said electrode, positioning a field defining member on the side of said surface opposite said electrode, and establishing a d.c. electric field between said shield and said member.

6. The method of claim 5 further including the steps of constructing said electrode in the form of an elongated wire, constructing said shield in the shape of an elongated U-shaped member, constructing said surface of a photosenstive material, mounting said surface on a conductive base, and applying a d.c. potential between said shield and said base.

7. The method of claim 5 wherein the step of establishing said d.c. field is accomplished by biasing said shield to a negative potential with respect to said member.

8. The method recited in claim 7 wherein said surface comprises a photoconductive material carried on a conductive substrate and wherein said shield and said substrate are coupled to different reference potentials in order to establish said d.c. electric field.

9. A corona generating device for depositing a negative charge on an imaging surface carried on a conductive substrate held at a reference potential comprising:

a corona discharge electrode including an elongated conductive member coated with a thick dielectric coating, the thickness of the coating adapted to prevent a net d.c. current from said source through said electrode, conductive shield located adjacent said electrode, and power supply means for applying an a.c. corona generating potential to said member and a negative d.c. potential to said shield relative to said reference potential.

10. The combination recited in claim 9 wherein said coating is glass.

11. The combination recited in claim 9 wherein the coating is a ceramic material.

12. The combination recited in claim 9 wherein said power supply means is variable to effect a change in the characteristic output of said device.

13. The combination recited in claim 9 wherein said substrate is held at ground potential and said shield is held at a potential negative with respect thereto.

14. A corona generating discharge device for altering the charge on an imaging surface carried on a conductive substrate comprising a corona discharge member including an inner conductive electrode with an outer dielectric coating, the thickness of said coating being selected to prevent a net d.c. current from being drawn from said source through said electrode, a conductive shield located adjacent said member, power supply means for applying an a.c. corona generating voltage to said electrode and providing a d.c. potential between said substrate and said shield, and means for varying said power supply means to change the charge delivered by said device to an imaging surface at a given potential.

15. The combination recited in claim 14 wherein said coating is glass.

16. The combination recited in claim 14 wherein said coating is a ceramic material.

17. The combination as recited in claim 14 wherein said power supply means maintains said shield at a negative potential with respect to said substrate.

18. The combination recited in claim 17 wherein said power supply means holds said substrate at ground potential and said a.c. corona generating potential varies about ground potential.

19. An improved method for changing the characteristic output of a corona generating device in an electrostatographic reproduction machine including an imaging surface carried on a conductive substrate comprising the steps of:

locating a corona generating member adjacent an imaging surface, said member including a conductive electrode coated with a dielectric material, positioning a conductive shield adjacent said member connecting an a.c. corona generating potential to said electrode, applying an electrical potential between said substrate and shield, and varying either of said potentials to change the characteristic charge output of said corona device.

20. In combination, a corona discharge member, a charge collecting surface, a conductor positioned on the side of said surface remote from said member and held a reference potential, said corona discharge member comprising a wire coated at least in the discharge area with a dielectric material, means for generating an a.c. corona discharge adjacent said member, a conductive shield adjacent said wire and biasing means for holding said shield at a potential different than said reference potential, said dielectric material preventing a net d.c. current through said wire.

21. The combination recited in claim 20 wherein said material is glass.

22. The combination recited in claim 20 wherein said shield is held at a negative potential with respect to said reference potential.

23. The combination recited in claim 20 wherein said surface to be charged is a photoconductor and said conductor is a substrate on which said photoconductor is carried.

24. In combination, a corona discharge member including an electrode having a dielectric coating to substantially prevent the flow of conduction current therethrough, a surface to be charged, first and second conductors, said surface to be charged positioned intermediate said first conductor and said member, biasing means for holding said second conductor at a constant potential relative to said first conductor in order to define a field therebetween, and means for creating an a.c. corona discharge adjacent said member.

25. The combination recited in claim 24 wherein said dielectric is glass.

26. The combination recited in claim 24 wherein said second conductor is positioned on the side of said member remote from said surface to be charged.

27. The combination recited in claim 24 wherein said second conductor is held at a negative potential with respect to said first conductor.

28. The combination recited in claim 24 wherein said surface to be charged is a photoconductor and said first conductor comprises a substrate on which said photoconductor is carried.

* * * * *

UNITED STATES PATENT AND TRADEMARK OFFICE

CERTIFICATE OF CORRECTION

PATENT NO. : 4,086,650

DATED : April 25, 1978

INVENTOR(S) : Thomas G. Davis; George J. Safford

It is certified that error appears in the above-identified patent and that said Letters Patent are hereby corrected as shown below:

COLUMN 4, LINE 31 - change "effected" to "affected".

COLUMN 6, LINE 56 - change "so" to "do".

COLUMN 8, LINE 10 - delete "in", first occurence.

COLUMN 9, LINE 18 - change "shiel" to "shield".

COLUMN 9, LINE 19 - delete "action", second occurence.

COLUMN 12, LINE 27 - insert "at" at end of line.

Signed and Sealed this

*Tenth* Day of *October 1978*

[SEAL]

*Attest:*

RUTH C. MASON
*Attesting Officer*

DONALD W. BANNER
*Commissioner of Patents and Trademarks*